US010928042B2

(12) United States Patent
Dong et al.

(10) Patent No.: US 10,928,042 B2
(45) Date of Patent: Feb. 23, 2021

(54) DOWNLIGHT APPARATUS

(71) Applicant: XIAMEN ECO LIGHTING CO. LTD., Xiamen (CN)

(72) Inventors: Yongzhe Dong, Xiamen (CN); Hai yan Chen, Xiamen (CN); Xiaoliang Wen, Xiamen (CN); Shouqiang Hou, Xiamen (CN); Zhenkun Huang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/513,638

(22) Filed: Jul. 16, 2019

(65) Prior Publication Data

US 2020/0232627 A1 Jul. 23, 2020

(30) Foreign Application Priority Data

Jan. 21, 2019 (CN) ..... 201920098439.0

(51) Int. Cl.

| | |
|---|---|
| ***F21V 21/04*** | (2006.01) |
| ***F21V 23/00*** | (2015.01) |
| ***F21V 3/00*** | (2015.01) |
| ***F21V 7/04*** | (2006.01) |
| *F21Y 113/13* | (2016.01) |
| *F21Y 115/10* | (2016.01) |

(52) U.S. Cl.

CPC ..... *F21V 21/04* (2013.01); *F21V 3/00* (2013.01); *F21V 7/04* (2013.01); *F21V 23/003* (2013.01); *F21Y 2113/13* (2016.08); *F21Y 2115/10* (2016.08)

(58) Field of Classification Search

CPC ..... F21S 8/04; F21V 19/00; F21V 21/108; F21V 23/00

See application file for complete search history.

(56) References Cited

U.S. PATENT DOCUMENTS

| | | | | |
|---|---|---|---|---|
| 10,415,799 | B1 * | 9/2019 | Grove | F21V 13/14 |
| 2017/0191628 | A1 * | 7/2017 | Nelkin | F21V 17/002 |

* cited by examiner

*Primary Examiner* — Joseph L Williams

(74) *Attorney, Agent, or Firm* — Chun-Ming Shih; Lanway IPR Services

(57) ABSTRACT

A downlight apparatus includes a main housing, a light module capable of emitting light, a driving module electrically connected to the light module and configured to enable the light module to emit the light. The downlight apparatus includes an optical module mechanically coupled to the main housing, and the optical module is configured for receiving the light emitted by the light module and directing the light toward a forward direction. The downlight apparatus includes an installation module for facilitating installment of the main housing to a receptacle, and includes a replaceable surface housing removably coupled to the main housing.

20 Claims, 7 Drawing Sheets

DOWNLIGHT APPARATUS

FIELD

The present invention is related to a downlight apparatus, and more particularly related to an LED downlight apparatus with a replaceable surface housing.

BACKGROUND

As an indispensable part of modern interior and exterior decoration, lighting fixtures have both functional and decorative significance, which greatly affect the overall layout and final effect of the decoration. With the development of the technology, consumers are increasingly demanding the decorative requirements of lighting fixtures, which puts higher demands on the appearance, lighting effects and diversity of lighting functions of lighting fixtures. The downlight apparatuses have been widely adopted for indoor and outdoor decoration. The downlight apparatuses could be installed onto the ceiling or the wall, and only minimum amount of spaces are required. Such arrangement could reduce the feeling of oppression, and create a warm and cozy lighting atmosphere.

The function and the lighting modes of the traditional downlight apparatuses are very limited. When the consumers desire to change or enhance the lighting effect, the installed downlight apparatus has to be completely disassembled and reinstalled. The overall process could be complicated, and may result in higher cost.

SUMMARY OF INVENTION

The present disclosure relates to a downlight apparatus, which may be easily detached after being installed. As such, the outlook and the lighting performance of the downlight apparatus may be easily changed and enhanced without complicated installation process.

In one embodiment, the downlight apparatus includes a main housing, a light module capable of emitting light, a driving module electrically connected to the light module and configured to enable the light module to emit the light. The downlight apparatus includes an optical module mechanically coupled to the main housing, and the optical module is configured for receiving the light emitted by the light module and directing the light toward a forward direction. The downlight apparatus includes an installation module for facilitating installment of the main housing to a receptacle, and includes a replaceable surface housing removably coupled to the main housing.

The driving module further includes a cover, a base, a driving circuit board, and a control device electrically connected to the driving circuit board. The base is mechanically coupled to the cover and form a compartment containing the driving circuit board.

The light module includes a plurality of groups of LED chips, and each group of the LED chips is capable of emitting light of a different color. The driving module is configured to receive control signals from the control device to enable a combination of the plurality of groups of LED chips so as to generate light of a desired color. The desired color may match color of the replaceable surface housing.

In another embodiment, the light module includes a plurality of groups of LED chips, and each group of the LED chips is capable of emitting light with a different color temperature. The driving module is configured to receive control signals from the control device to enable a combination of the plurality of groups of LED chips to emit light with a desired color temperature. The desired color may match color of the replaceable surface housing.

In some embodiments, the control device is arranged at a peripheral area of driving circuit board and is concealed by the replaceable surface housing when the surface housing is coupled to the main housing.

In some embodiments, the driving module includes a cover, a base, a driving circuit board, and a wireless control device electrically connected to the driving circuit board. The base is mechanically coupled to the cover and form a compartment, and the driving circuit board is arranged inside the compartment. The wireless control device may include a Bluetooth communication unit, a Wi-Fi communication unit, an IrDA communication unit, or a ZigBee communication unit.

The driving circuit board has a first side facing the cover and a second side facing the base, where the wireless control device has a first part located on the first side and a second part located on the second side.

The second part of the wireless control device includes an antenna for receiving and transmitting radio frequency signals. The base includes a slot for receiving the second part of the wireless control device to extend through the base.

In some embodiments, the optical module includes a first optical component and a second optical component, and the second optical component includes a light reflecting surface for reflecting light emitted by the light module toward the first optical component. The first optical component may include a lens or a light transmitting cover. The second optical component may include a light reflective cup.

The main housing may be made of metal or thermal plastic materials. The replaceable surface housing may be made of plastic, metal, glass or stone material. The main housing is configured with a notch located close to an edge of the replaceable surface housing. A back side of the replaceable surface housing is configured with a protrusion portion. The replaceable surface housing may be installed along a horizontal direction of the main housing by inserting the protrusion portion into the notch and then rotating the replaceable surface housing against the main housing.

In the present disclosure, the replaceable surface housing of the downlight apparatus may be detachable from the main housing by reversely rotating the replaceable surface housing against the main housing. Thus, the appearance of the downlight apparatus may be easily replaced without opening the ceiling, the wall, or the ceiling structure. The lighting color or color temperature of the light module may be easily configured by replacing the replaceable surface housing. In this way, the lighting performance and the visual appearance of the downlight apparatus may be configured in accordance with the lighting modes

DETAILED DESCRIPTION

The present disclosure will be further described in detail below with reference to the accompanying drawings and embodiments. It is understood that the specific embodiments described herein are merely illustrative of the claimed invention and are not intended to limit the claimed invention.

Figure 1:
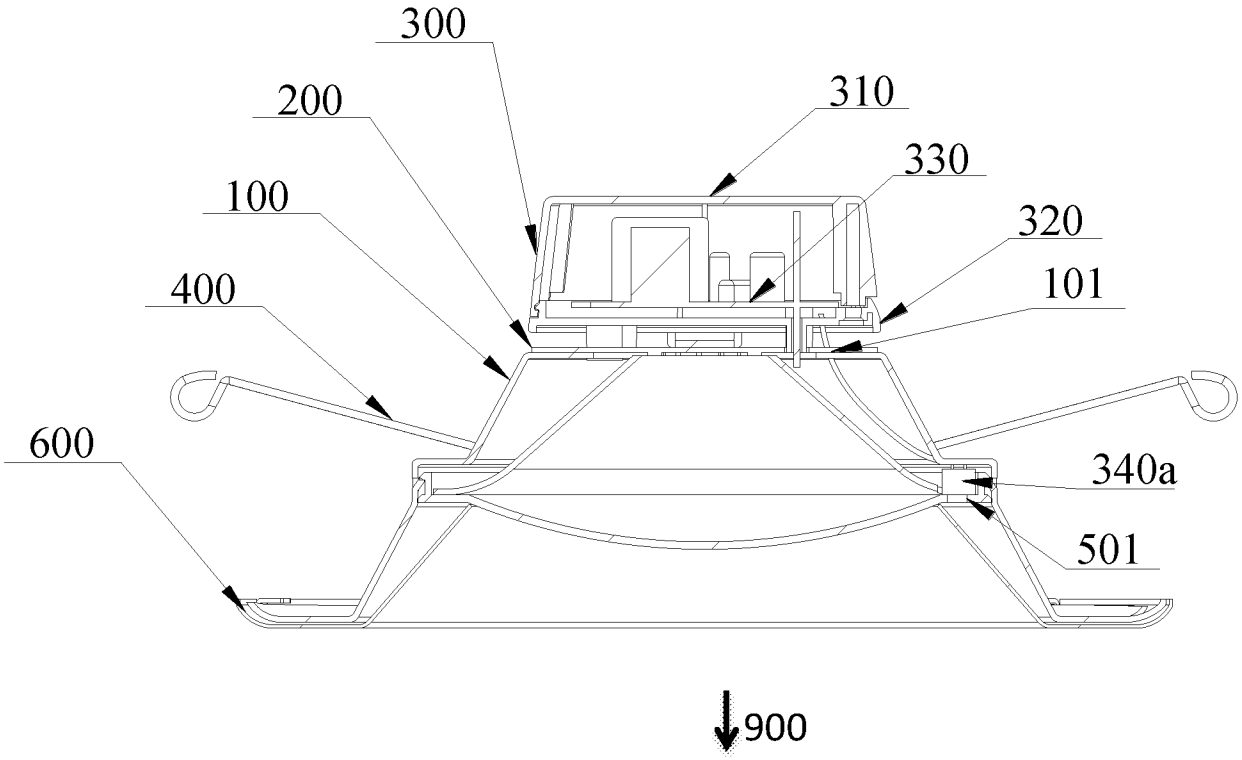
FIG. 1 is a cross section view of the downlight apparatus in accordance with one embodiment of the present disclosure.
Figure 2:
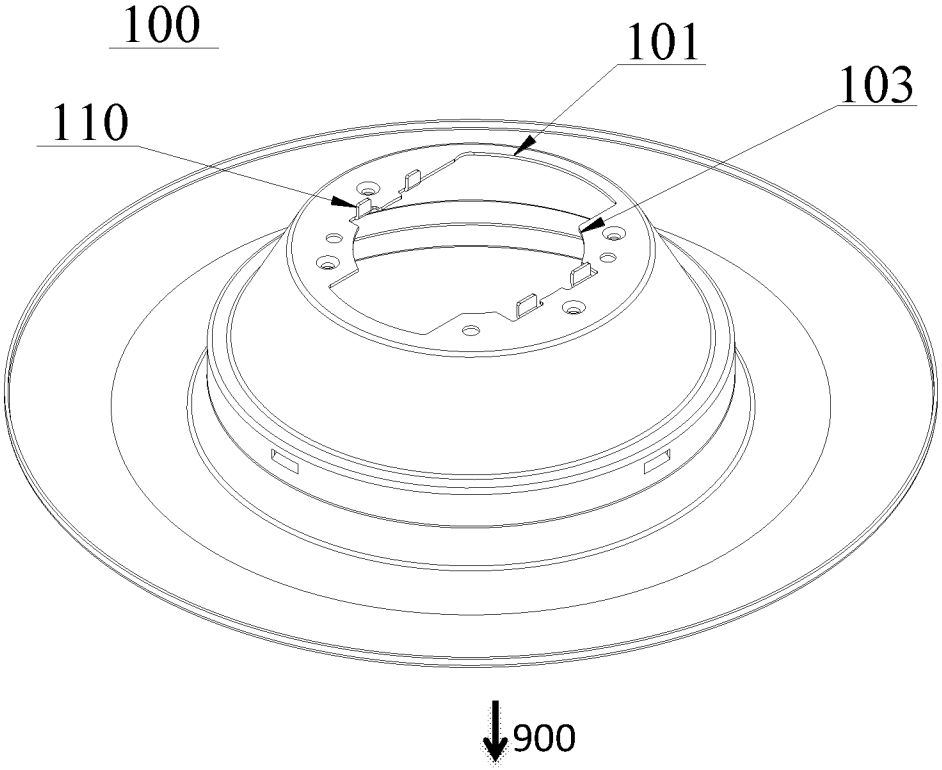
FIG. 2 is a schematic view of the main housing of the downlight apparatus in accordance with one embodiment of the present disclosure.
Figure 3:
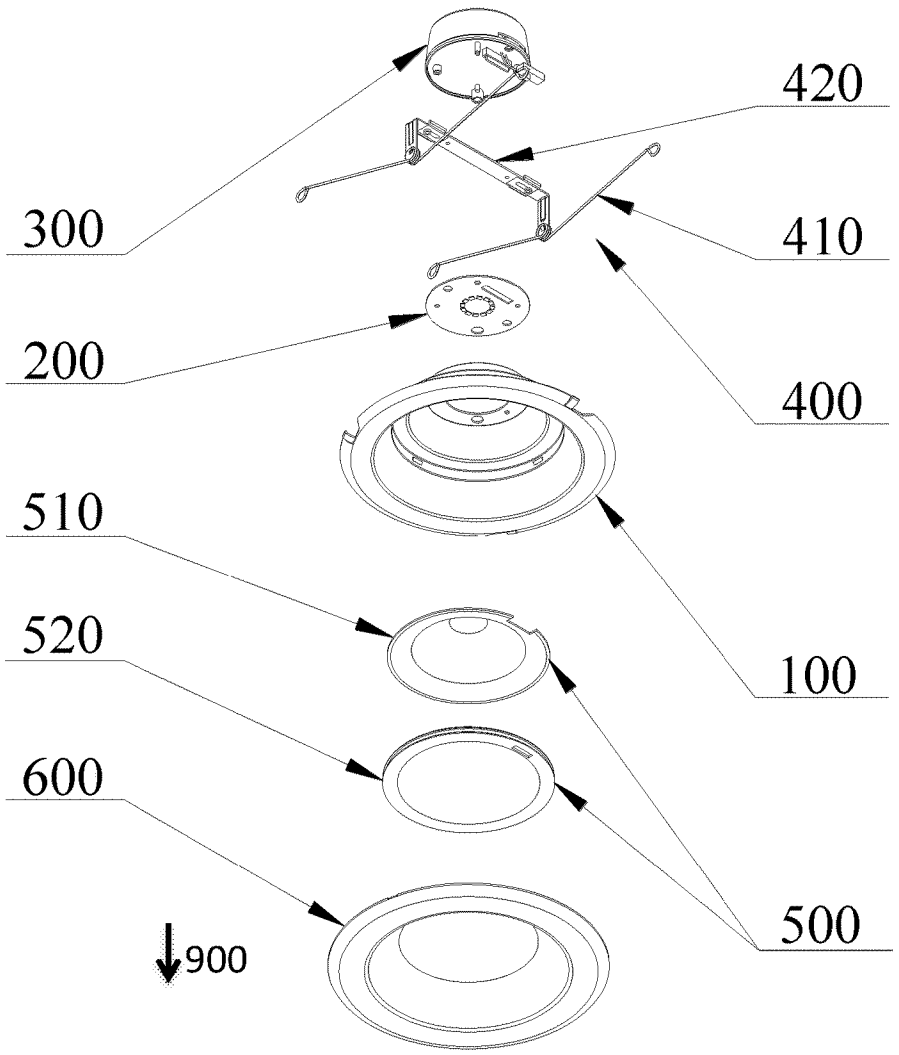
FIG. 3 is an exploded view of the downlight apparatus in accordance with one embodiment of the present disclosure.

Refer to FIG. 1 to FIG. 3. In one embodiment, the downlight apparatus includes a main housing 100, a light module 200 capable of emitting light, a driving module 300 electrically connected to the light module 200 and configured to enable the light module 200 to emit the light. The downlight apparatus includes an optical module 500 mechanically coupled to the main housing 100, and the optical module 500 is configured for receiving the light emitted by the light module 200 and directing the light toward a forward direction 900. The downlight apparatus includes an installation module 400 for facilitating installment of the main housing 100 to a receptacle (not shown) on a ceiling or a wall. The downlight apparatus further includes a replaceable surface housing 600 removably coupled to the main housing 100.

Refer to FIG. 2, a placement hole 101 may communicate with a light emission hole 103.

Figure 4:
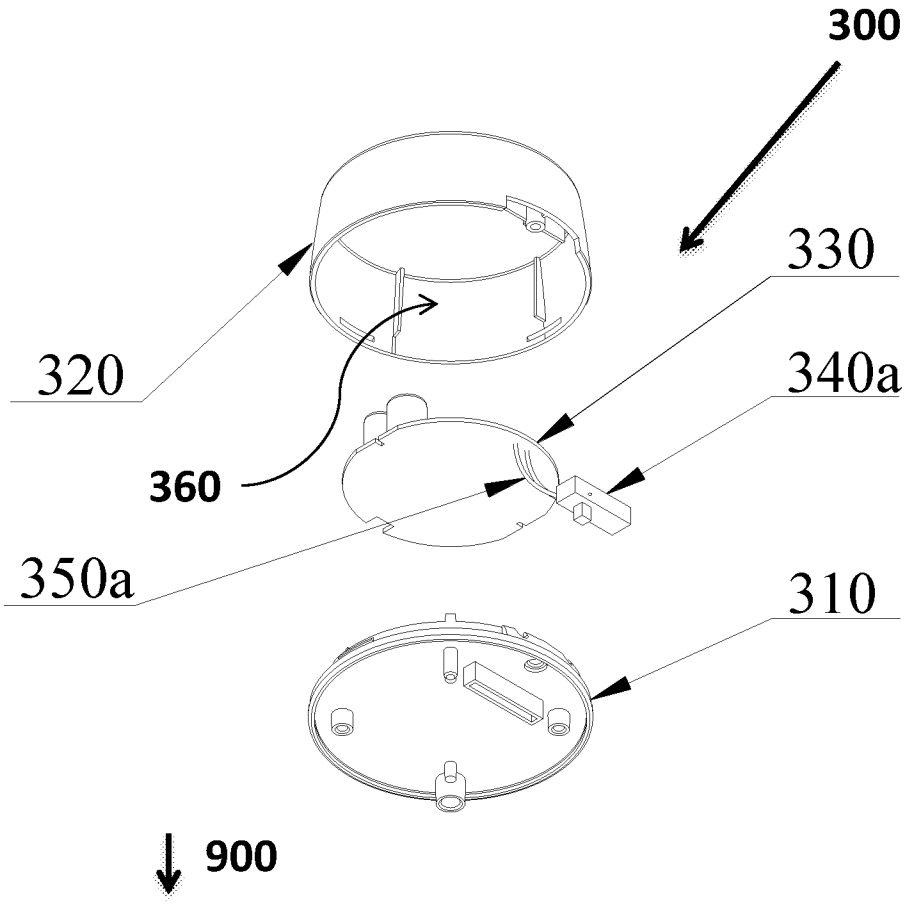
FIG. 4 is an exploded view of the driving module in accordance with one embodiment of the present disclosure.

Refer to FIG. 4. The driving module 300 further includes a cover 320, a base 310, a driving circuit board 330, and a control device 340*a* electrically connected to the driving circuit board 330. The base 320 is configured to be mechanically coupled to the cover 320 and form a compartment 360 to contain the driving circuit board 330. The control device 340*a* connects to the driving circuit board 330 via wires 350*a*. The control device 340*a* may be a button regulator, a switch step regulator, or a touch-screen regulator. Further, the control device 310 may be arranged around a peripheral area of the driving circuit board 330 so the control device 310 may be visually concealed by the replaceable surface housing 600 when the replaceable surface housing 600 is coupled to the main housing 100.

Referring to FIG. 1, the driving module 300 includes a control message receiving module. The main housing 100, the light module 200, an edge of the second optical component 510, and an edge of the first optical component 520 corresponding to the second optical component 510 are configured with the placement hole 101 for being passed through by the control message receiving module.

Specifically, the main housing 100 and the light module 200 are configured with the placement hole 101. The wires 350*a* of the driving module 300 pass through the placement hole 101 so as to connect the control device 340*a* and the driving circuit board 330. In this way, the control device 340*a* may be installed within a space between the main housing 100 and the second optical component 510. In addition, the control device 340*a* may extend to the space between the main housing 100 and the replaceable surface housing 600 via the placement hole 101. As such, after the replaceable surface housing 600 is detached, the lighting mode of the light module 200 may be adjusted by the control device 340*a*. Alternatively, the wireless signal transceiver of the driving module 300 may extend to the space between the main housing 100 and the second optical component 510 via the placement hole 101. As such, the user can conveniently input the control information to the wireless signal transceiver through the optical module 500 without electromagnetic shielding effect, and finally to the driving module, thereby control the color temperature, brightness, and the like output by the light module 200.

As the replaceable surface housing 600 may be easily detached, the color, the color temperature, or the luminance of the light module 200 may be easily configured by the control device 340*a*. In this way, the optical spectrum, the light modes, and the optical performance of the downlight apparatus may be adjusted accordingly.

Figure 6:
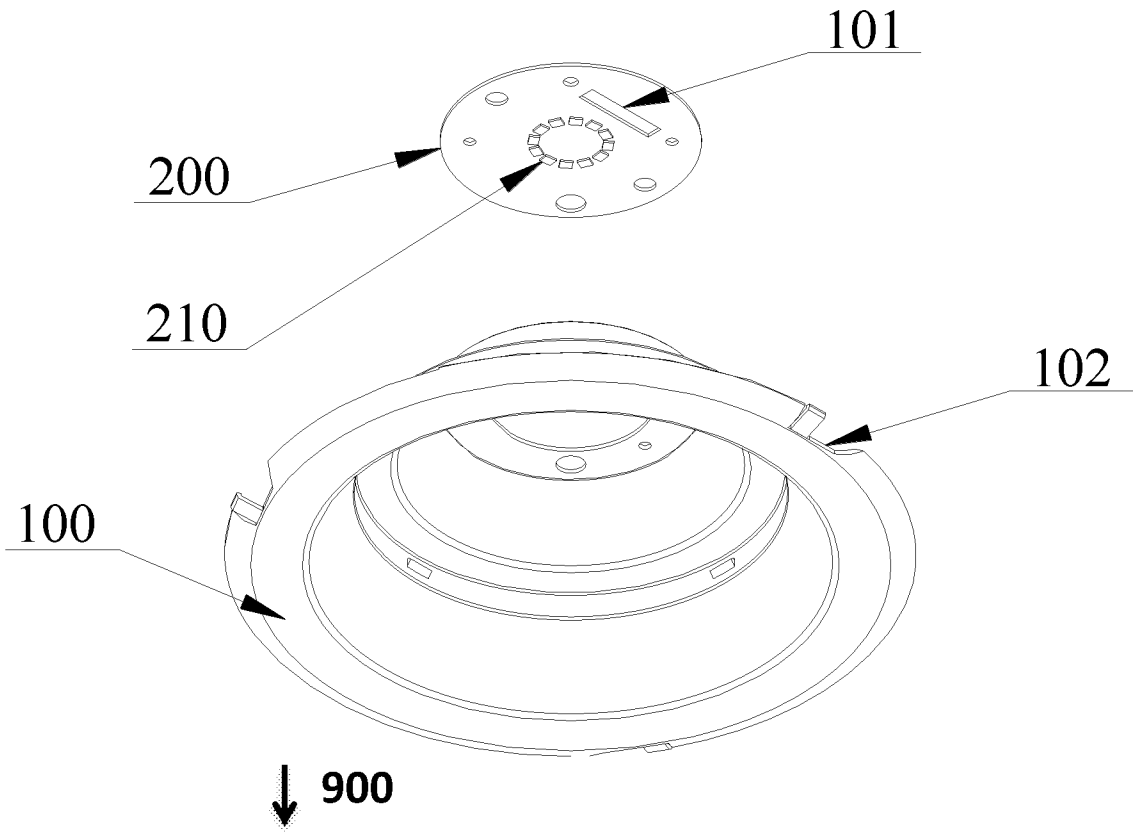
FIG. 6 is a schematic view showing a portion of the downlight apparatus in accordance with one embodiment of the present disclosure.

Refer to FIG. 6. The light module 200 includes a plurality of groups of LED chips 210, and each group of the LED chips 210 is capable of emitting light of a different color. For example, the light module 200 may include four groups of LED chips, including a first group of LED chips capable of emitting red light, a second group of LED chips capable of emitting green light, a third group of LED chips capable of emitting blue light, and a fourth group of LED chips capable of emitting white light. The driving module 300 is configured to receive control signals from the control device 340*a* to enable a combination of the plurality of groups of LED chips so as to generate light of a desired color. The desired color may match color of the replaceable surface housing 600 such that the downlight apparatus may be aesthetically pleasing when the combination of the plurality of groups of LED chips are enabled.

In another embodiment, the light module 200 includes a plurality of groups of LED chips, and each group of the LED chips is capable of emitting light with a different color temperature. For example, the light module 200 may include a first group of LED chips capable of emitting light of a first color temperature (e.g., 3000K) and a second group of LED chips capable of emitting light of a second color temperature (e.g., 6000K). The driving module 300 is configured to receive control signals from the control device 340*a* to enable a combination of the plurality of groups of LED chips to emit light with a desired color temperature. For example, when the first group of LED chips are enabled and the second group of LED chips are not enabled, the light module 200 would emit light of a desired color temperature of 3000K, which is generally regarded as a warm color. When the second group of LED chips are enabled and the first group of LED chips are not enabled, the light module 200 would emit light of a desired color temperature of 6000K, which is generally regarded as a cool color. When both the first group and second group of LED chips are enabled, the light module 200 would emit light of a desired color temperature around 4500K. The desired color temperature may match the color of the replaceable surface housing 600 such that the downlight apparatus may be aesthetically pleasing when the combination of the plurality of groups of LED chips are enabled. For example, if the desired color temperature is 3000K, the color of the replaceable surface housing 600 may be a warm color, for example, yellow or orange. If the desired color temperature is 6000K, the color of the replaceable surface housing 600 may be a cool color, for example, blue or white.

Refer to FIG. 6. a notch 102 is configured along an edge of the bowl-shaped main housing 100. A protrusion portion (not shown) is configured on a back side of the replaceable surface housing 600. The protrusion portion could be inserted into the notch 102, and by rotating the replaceable surface housing 600, the replaceable surface housing 600 could be installed onto the main housing 100. A gap is configured between the edge and a wall of the bowl-shaped main housing 100. Alternatively, the main housing 100 could be mounted onto the ceiling, and the protrusion portion could be disposed on the back of the replaceable surface housing 600. In another embodiment, the number of the notches 102 is the same as the number of the protrusion portions, and the locations of the notches 102 correspond to locations of the protrusion portions. A length of the protrusion portion is smaller than the length of the notch 102. The main housing 100 and the replaceable surface housing 600 may be easily coupled and connected. With such arrangement, the user may easily replace the replaceable surface housing 600 in accordance with his/her demands.

In an example, the protrusion portion may be arranged along an edge of the main housing 100. With such arrangement, by rotating the replaceable surface housing 600 against the main housing 100 in a forward direction, the replaceable surface housing 600 could be fixed onto the main housing 100. By rotating the replaceable surface housing 600 against the main housing 100 in a reverse direction, the replaceable surface housing 600 may be detached from the main housing 100.

The main housing may be made of metal or thermal plastic materials. The replaceable surface housing may be made of plastic, metal, glass or stone materials.

In one embodiment, the main housing 100 may function as the main support and also as the heat sink of the downlight apparatus. The main housing 100 may be of bowl-shaped structure, and the main housing 100 may be made of metal, such as aluminum or aluminum alloy materials, or thermally conductive plastics. The replaceable surface housing 600 may shield the wall of the main housing 100 and may decorate the downlight apparatus so as to enhance the appearance of the downlight apparatus.

Figure 5:
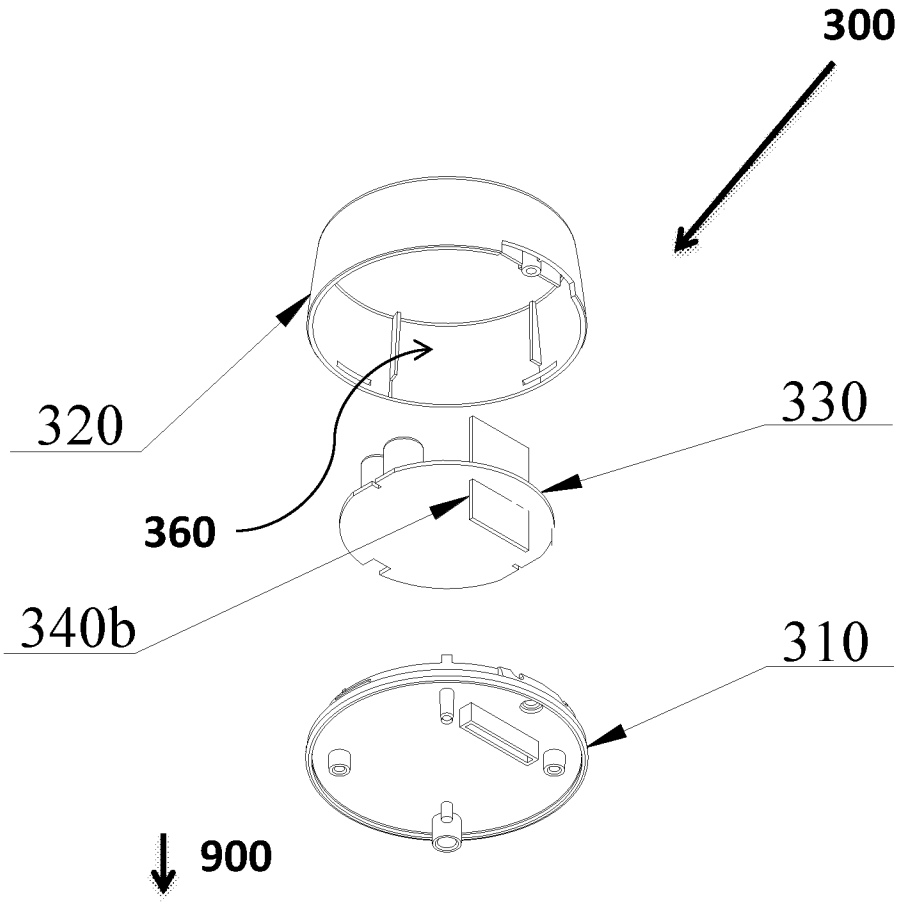
FIG. 5 is an exploded view of the driving module in accordance with another embodiment of the present disclosure.

In some embodiments, the control device may be a wireless control device. Refer to FIG. 5. The driving module 300 includes a cover 320, a base 310, a driving circuit board 330, and a wireless control device 340*b* electrically connected to the driving circuit board 330. The base 310 is mechanically coupled to the cover 320 and form a compartment 360, and the driving circuit board 330 is arranged inside the compartment 360.

The wireless control device 340*b* is soldered on the driving circuit board 330. The wireless control device 340*b* includes the wireless signal transceiver for receiving wireless signals, so as to accordingly control the LED chips 210 of the light module 200 to emit light of various colors, color temperatures, or luminance . . . etc. In one embodiment, the wireless signals transceiver may also transmit the operational status of the light module 200 back to the users for reference.

The wireless control device 340*b* may include a Bluetooth communication unit, a Wi-Fi communication unit, an IrDA communication unit, or a ZigBee communication unit so as to transmit and receive wireless signals.

The wireless control device 340*b* may establish the wireless connections with remote devices via the wireless signal transceiver, such as connecting to the users' terminal through Bluetooth or ZigBee connection, accessing the home LAN through Wi-Fi wireless network, receiving the control signals of the users' terminal, or providing the operational status of the downlight apparatus. Also, the control signals of the remote device may be received by IRDA connection.

Referring to FIGS. 1 and 2, the light module 200 is attached to a back side of the bottom of the main housing 100. The light module 200 is disposed between the driving module 300 and the main housing 100. A positioning rib 110 is arranged on an edge of the light emission hole 103 facing toward the light module 200. The positioning rib 110 is configured to fix the light module 200 onto the main housing 100 along the horizontal direction.

In an example, the light module 200 is the main source of heat, and the main housing 100 is the main heat sink. By adhering the light module 200 onto the main housing 100 by a fastener piece, the heat of the light module 200 may be dissipated in an efficient way, which ensures the operational temperature of the light module 200. The fastener piece may be a screw, a rivet, or a bolt and a nut. Alternatively, a thermal pad is disposed between the main housing 100 and the light module 200, and the thermal pad is soft and has good thermal conductivity. In another example, the thermal pad may be made by silicone, and the thermal pad is disposed close to the main housing 100. In addition, the thermal pad is fully contacted with the light module 200, so the heat conduction efficiency between the light module 200 and the main housing 100 can be improved. In an example, the number of the positioning rib 110 may be greater than 2, or may be equal to four. At least one corresponding hole may be configured on the light module 200. The number of the hole is the same as the number of the positioning rib 110. The positioning rib 110 and the light module 200 are assembled by the fastener piece along the horizontal direction of the main housing 100.

In FIG. 5, the driving circuit board 330 has a first side 332 facing the cover 320 and a second side 334 facing the base 310, where the wireless control device 340*b* has a first part located on the first side and a second part located on the second side. The second part of the wireless control device 340*b* may include an antenna for receiving and transmitting radio frequency signals. The base 310 may further include a slot 315 for receiving the second part of the wireless control device 340*b* to extend through the base 310. With such arrangement, the performance of the wireless control device 340*b* may be improved.

Figure 7:
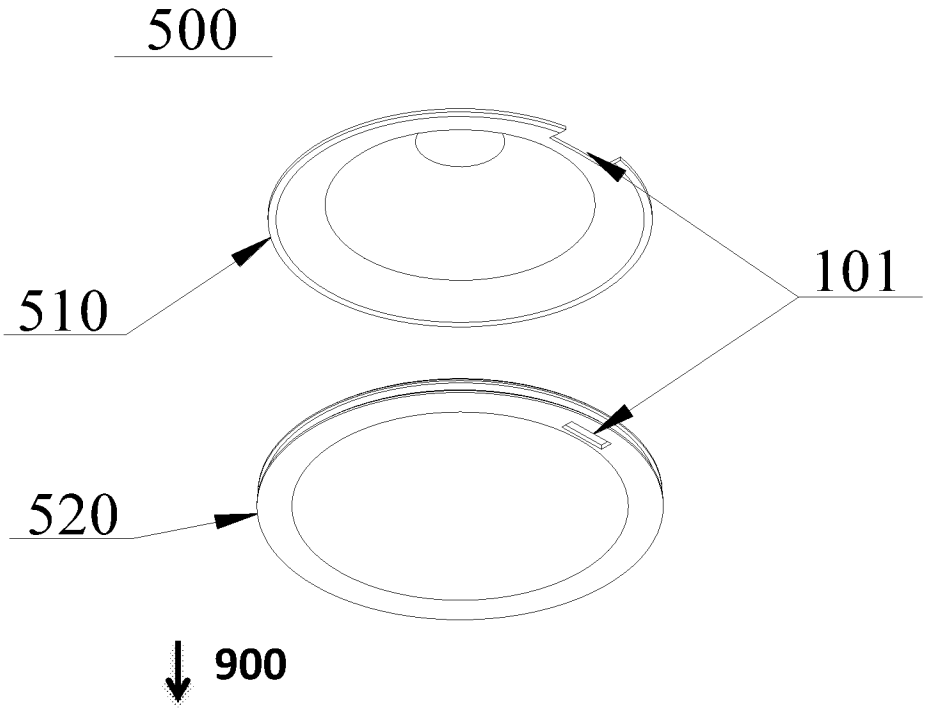
FIG. 7 is a schematic view of the optical module in accordance with one embodiment of the present disclosure.

Refer to FIG. 7. The optical module 500 includes a first optical component 520 and a second optical component 510. The second optical component 510 may include a light reflecting surface for reflecting light emitted by the light module 200 toward the first optical component 520. The first optical component 520 may include a lens or a light transmitting cover. The second optical component 510 may include a light reflective cup.

Refer to FIG. 3. The second optical component 510 is of a bowl-shaped structure without a bottom. That is, the second optical component 510 includes a first end and a second end, and a diameter of the first end is smaller than the diameter of the second end. The first end of the second optical component 510 faces toward the light module 200. The first optical component 520 connects to one side of the main housing 100 facing toward the replaceable surface housing 600. The second end of the second optical component 510 abuts against the first optical component 520. The second optical component 510 may be a reflector or the reflective paper for guiding the light emitted by the light module 200 to the surrounding of the bowl-shaped main housing 100. Specifically, the first optical component 520 is connected to the inner side of the main housing 100 by buckle or adhesion. In another example, the light beams from the light module 200 and the light beams from the second optical component 510 are scattered by the first optical component 520, so the light of the downlight apparatus is more uniform and the illumination effect is softer.

When the downlight apparatus is installed by the installation module 400, the driving module 300 receives the control signals from the remote terminals or switches. The light module 200 is driven by the control signals, and the light beams from the light module 200 are modulated by the optical module 500. Afterward, the light beams are emitted toward the illumination space. The replaceable surface housing 600 may be configured with different material or colors so as to provide an integral lighting performance with the optical spectrum. The lighting mode of the light module 200 may be easily configured by the remote terminals or switches, and the appearance of the downlight apparatus may also be easily changed by detaching the replaceable surface housing 600 from the main housing 100 and then replacing it with a new one.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

We claim:

1. A downlight apparatus, comprising:

a main housing;

a light module capable of emitting light, the light module is mechanically coupled to the main housing;

a driving module electrically connected to the light module, the driving module is configured to enable the light module to emit the light, wherein the driver module has a control device;

an optical module for receiving the light emitted by the light module and directing the light toward a forward direction, the optical module is mechanically coupled to the main housing;

an installation module for facilitating installment of the main housing to a receptacle;

a replaceable surface housing removably coupled to the main housing, wherein the control device is visually concealed by the replaceable surface housing and adjustable when detaching the replaceable surface.

2. The downlight apparatus of claim 1, wherein the driving module further comprises a cover, a base, and a driving circuit board, and the control device electrically connected to the driving circuit board, wherein the base is mechanically coupled to the cover and form a compartment, the driving circuit board is arranged inside the compartment.

3. The downlight apparatus of claim 2, wherein the light module comprises a plurality of groups of LED chips, and each group of the LED chips is capable of emitting light of a different color.

4. The downlight apparatus of claim 3, wherein the driving module is configured to receive control signals from the control device to enable a combination of the plurality of groups of LED chips so as to generate light of a desired color.

5. The downlight apparatus of claim 4, wherein the desired color matches color of the replaceable surface housing.

6. The downlight apparatus of claim 2, wherein the light module comprises a plurality of groups of LED chips, and each group of the LED chips is capable of emitting light with a different color temperature.

7. The downlight apparatus of claim 6, wherein the driving module is configured to receive control signals from the control device to enable a combination of the plurality of groups of LED chips to emit light with a desired color temperature.

8. The downlight apparatus of claim 2, wherein the control device is arranged at a peripheral area of driving circuit board and is concealed by the replaceable surface housing when the surface housing is coupled to the main housing.

9. The downlight apparatus of claim 1, wherein the driving module further comprises a cover, a base, a driving circuit board, and a wireless control device electrically connected to the driving circuit board, wherein the base is mechanically coupled to the cover and form a compartment, the driving circuit board is arranged inside the compartment.

10. The downlight apparatus of claim 9, wherein the light module comprises a plurality of groups of LED chips, where each group of the LED chips is capable of emitting light of a different color.

11. The downlight apparatus of claim 10, wherein the driving module is configured to receive control signals from the control device to enable a combination of the plurality of groups of LED chips to generate light of a desired color.

12. The downlight apparatus of claim 11, wherein the desired color matches color of the replaceable surface housing.

13. The downlight apparatus of claim 9, wherein the light module comprises a plurality of groups of LED chips, where each group of the LED chips is capable of emitting light with a different color temperature.

14. The downlight apparatus of claim 13, wherein the driving module is configured to receive control signals from the control device to enable a combination of the plurality of groups of LED chips to emit light.

15. The downlight apparatus of claim 9, wherein the wireless control device includes a Bluetooth communication unit, a Wi-Fi communication unit, an IrDA communication unit, or a ZigBee communication unit.

16. The downlight apparatus of claim 9, wherein the driving circuit board has a first side facing the cover and a second side facing the base, where the wireless control device has a first part located on the first side and a second part located on the second side.

17. The downlight apparatus of claim 16, wherein the second part of the wireless control device includes an antenna for receiving and transmitting radio frequency signals.

18. The downlight apparatus of claim 16, wherein the base includes a slot for receiving the second part of the wireless control device to extend through the base.

19. The downlight apparatus of claim 1, wherein the optical module comprises a first optical component and a second optical component, the second optical component includes a light reflecting surface for reflecting light emitted by the light module toward the first optical component.

20. The downlight apparatus of claim 19, wherein the first optical component includes a lens or a light transmitting cover, and the second optical component includes a light reflective cup.

* * * * *